United States Patent [19]

Carufel/Zeman

[11] Patent Number: 5,071,010

[45] Date of Patent: Dec. 10, 1991

[54] COLLAPSIBLE CONTAINER

[75] Inventor: Marie D. Carufel/Zeman, Kentwood, Mich.

[73] Assignee: Kentwood Packaging Corporation, Grand Rapids, Mich.

[21] Appl. No.: 550,069

[22] Filed: Jul. 9, 1990

[51] Int. Cl.[5] ..... B65D 19/00; B65D 5/42; B65D 5/35

[52] U.S. Cl. ..... 206/600; 229/23 C; 229/23 A; 229/199; 229/117.02

[58] Field of Search ..... 229/23 C, 23 A, 199, 229/117.02; 206/600, 577, 517

[56] References Cited

U.S. PATENT DOCUMENTS

| | | | |
|---|---|---|---|
| 2,246,097 | 6/1941 | Illges | 229/23 A |
| 2,775,393 | 12/1956 | Rugg | 229/117.02 |
| 2,947,462 | 8/1960 | Bostock | 229/199 X |
| 4,373,637 | 2/1983 | Shippell | 206/600 |
| 4,606,461 | 8/1986 | Bolton, Sr. | 206/600 |
| 4,682,727 | 7/1987 | Stoll | 229/DIG. 11 |
| 4,793,507 | 12/1988 | Delplanque | 206/600 X |
| 4,927,026 | 5/1990 | Gossler et al. | 206/600 |
| 4,949,898 | 8/1990 | Nederveld | 206/600 X |
| 4,969,559 | 11/1990 | Nederveld | 206/600 |

FOREIGN PATENT DOCUMENTS

| | | | |
|---|---|---|---|
| 544438 | 9/1922 | France | 229/117.02 |
| 1319389 | 1/1963 | France | 229/199 |
| 2480240 | 10/1981 | France | 206/600 |
| 1297915 | 11/1972 | United Kingdom | 229/23 C |

*Primary Examiner*—William I. Price

*Attorney, Agent, or Firm*—Warner, Norcross & Judd

[57] ABSTRACT

A collapsible container having a plurality of sidewalls and at least one bottom panel is constructed to collapse without any resultant increase in the lateral dimensions. Further, the collapse of the container is accomplished without substantially affecting the bottom panel of the container.

23 Claims, 4 Drawing Sheets

COLLAPSIBLE CONTAINER

BACKGROUND OF THE INVENTION

The present invention pertains to a container, and in particular, to a collapsible container.

Collapsible containers, such as cardboard boxes, are commonly employed to ship goods from one location to another. Frequently, once the goods have been removed from the boxes, the boxes are collapsed and returned to the sender. Conventional boxes are collapsed by outwardly folding the top and bottom portions and flattening the sides diagonally toward one another. This arrangement, however, substantially increases the lateral dimensions of the box as compared to its assembled shape. Such enlargement of the boxes further burdens handling and storage, and results in increased return shipping costs.

Additionally, containers are at times secured to pallets for increased strength and to facilitate handling of the containers with a fork lift truck. However, the boxes must generally be removed from the pallets before they can be collapsed. Under these circumstances, return of the boxes becomes very labor intensive and slow. Moreover, the sender of the goods must repeatedly re-secure the boxes to the pallets for their reuse.

SUMMARY OF THE INVENTION

In accordance with the present invention, a container having a unique construction is provided to overcome the aforementioned problems.

More specifically, the container collapses such that there is no resulting increase in its lateral dimensions. This construction eases handling of the containers and reduces return shipping costs. Additionally, collapse of the container is accomplished without movement of its bottom panel. This feature permits the container to be collapsed even if secured to a pallet. As can be readily appreciated, such collapse greatly enhances the use of pallet-container assemblies. In particular, the containers remain attached to the pallets through any number of returns and re-shipments.

These, and other objects, advantages, and features of the present invention will be more fully understood and appreciated by reference to the written specification and appended drawings.

DETAILED DESCRIPTION OF THE PREFERRED EMBODIMENT

Figure 1:
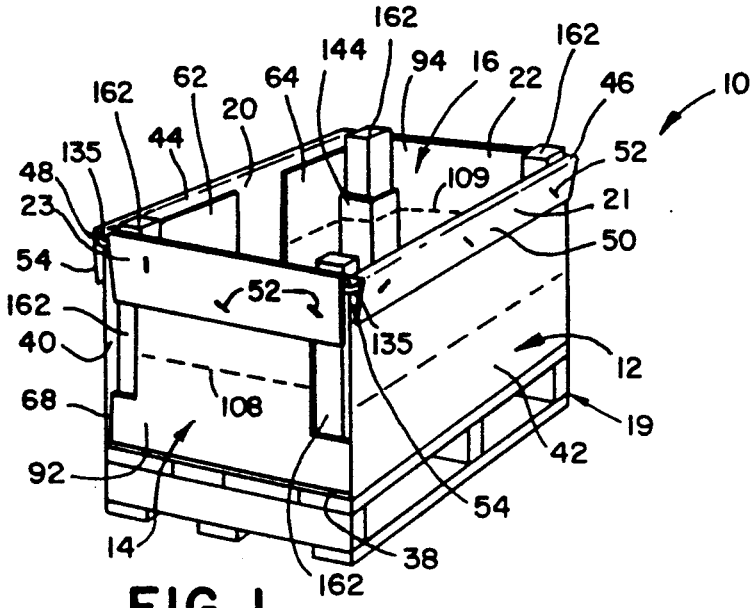
FIG. 1 is a perspective view of an erected container of the present invention.
Figure 2:
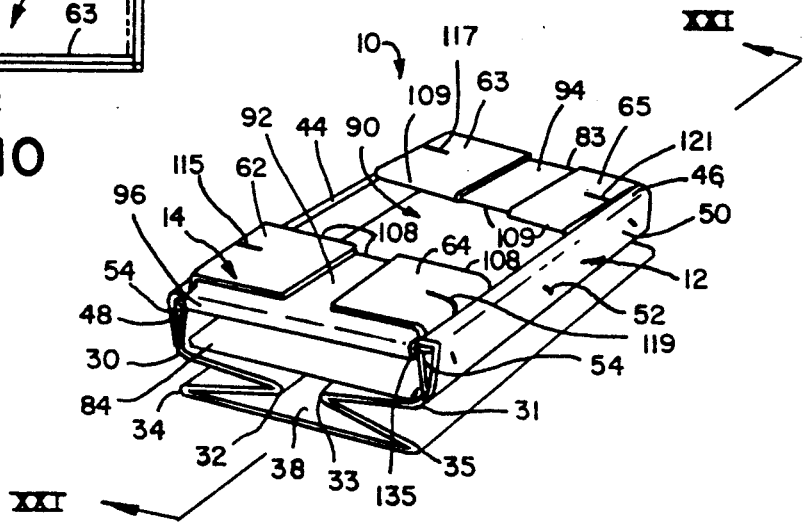
FIG. 2 is a perspective view of the container in a collapsed position.

In the preferred embodiment, a container 10 includes an outer member 12 and an inner member 14 which are uniquely folded and interconnected together. When erected or assembled, the inner and outer members define a generally rectangular cavity 16 into which various sorts of goods may be placed for storage, shipping, etc. (FIG. 1). When collapsed, members 12, 14 are cooperatively folded such that container 10 is collapsed directly downwardly without a resulting increase in its lateral dimensions (FIG. 2). The container further includes a lid 18 (FIG. 5) which is shaped and sized to matingly overfit the top portions 20–23 of outer and inner members 12, 14. Members 12, 14 and lid 18 are preferably composed of corrugated cardboard; but may however be composed of many other materials, such as various types of plastics.

Figure 12:
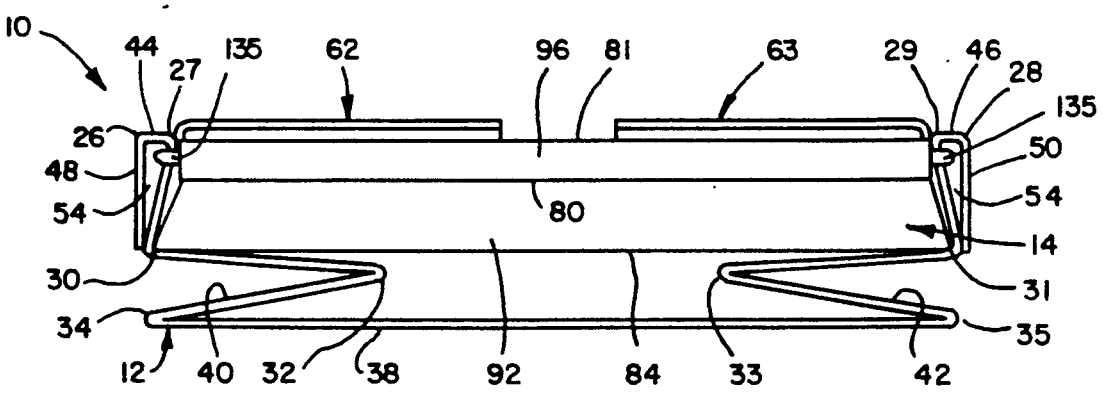
FIG. 12 is a side elevational view of the container in its collapsed position.
Figure 3:
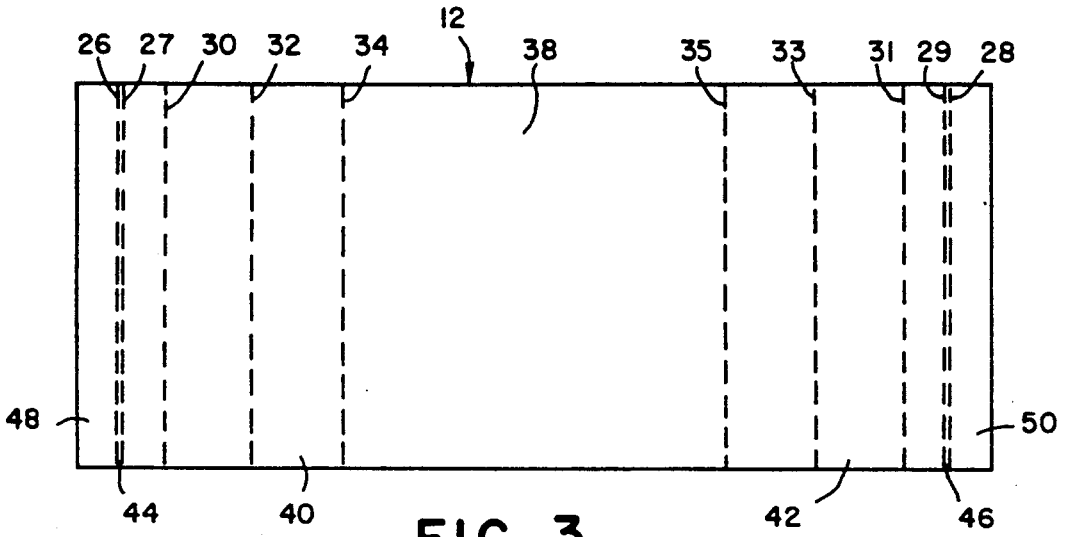
FIG. 3 is a top plan view of a blank defining the outer member of the container.

Outer member 12 is a large rectangular sheet provided with a number of fold lines 26–35 (FIG. 3). Fold lines 26–35 are arranged generally parallel to one another and at right angles to the longitudinal axis of the sheet comprising outer member 12. Outer member 12 is divided by fold lines 26–29, 34–35 into a bottom panel 38, side walls 40, 42, top edges 44, 46, and outer strips 48, 50. In an erected position (FIGS. 1 and 5), outer member 12 has a generally U-shaped configuration with sidewalls 40, 42 positioned at right angles to bottom panel 38 along fold lines 34, 35. Additionally, outer strips 48, 50 are doubled back along the top portions of sidewalls 40, 42 and secured thereto by staples 52 or other securing means, such as adhesive (FIGS. 1, 2 and 12). Fold lines 26, 27 and 28, 29 are spaced close together to define top edges 44, 46. The use of double fold lines instead of single fold lines, to separate outer strips 48, 50 from sidewalls 40, 42, forms a pair of narrow channels 54. Channels 54 extend across the entire top portions 20, 21 of outer member 12. Also, in its erected position, no folding occurs along fold lines 30–33. As explained below, folding along lines 30–33 is precluded by the expansion of inner member 14.

Figure 4:
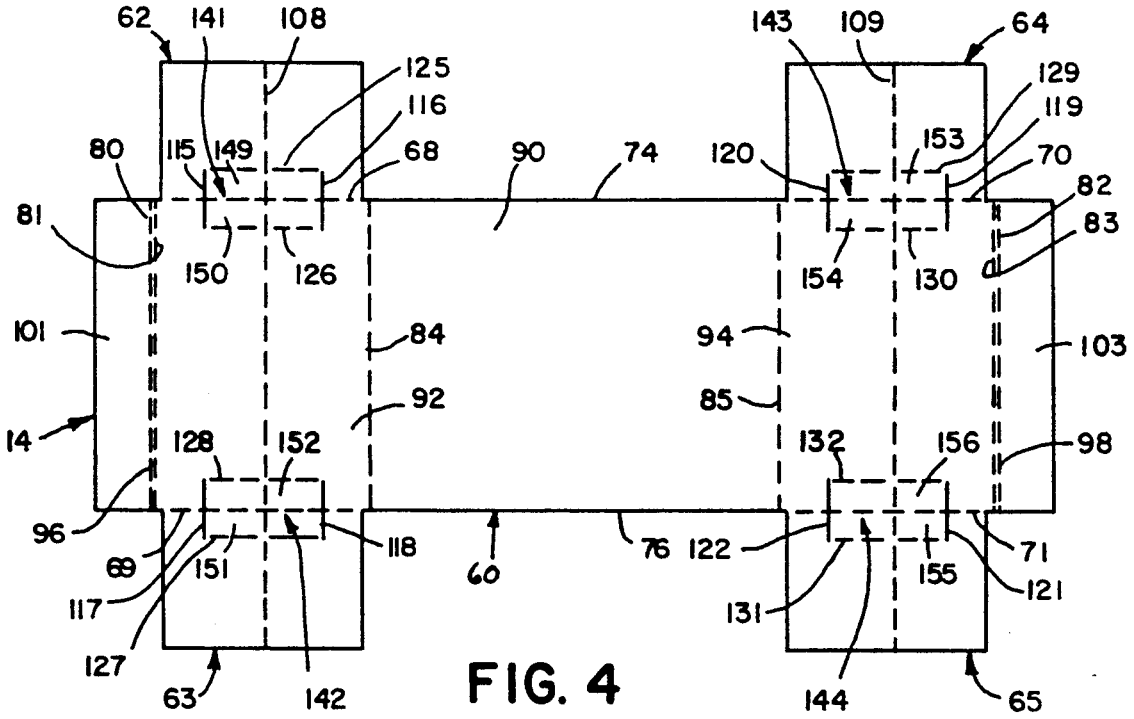
FIG. 4 is a top plan view of a blank defining the inner member of the container.

Inner member 14 includes a main rectangular body portion 60 and a plurality of outwardly extending auxiliary portions 62–65 (FIG. 4). Auxiliary portions 62–65 are separated from main body portion 60 by fold lines 68–71. Auxiliary portions 62–65 are arranged such that two such portions 62, 64 extend transversely outward from one longitudinal side 74 of body portion 60 and the other two such portions 63, 65 extend transversely outward from the other longitudinal side 76. Auxiliary portions 62–65 are further paired into opposed relationships such that auxiliary portion 62 is directly opposed to auxiliary portion 63, and auxiliary portion 64 is directly opposed to auxiliary portion 65.

Figure 11:
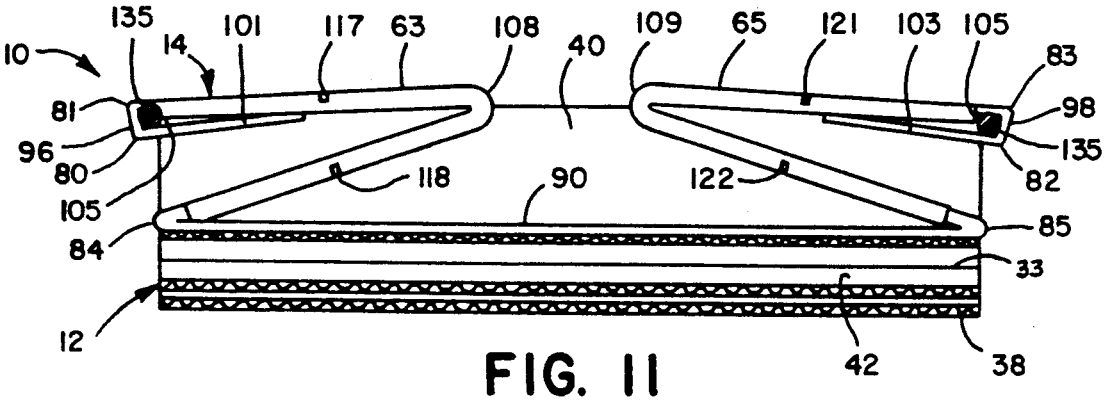
FIG. 11 is a cross-sectional view taken along line XI—XI in FIG. 2.

Main body portion 60 is further divided into several regions by a number of intermediate fold lines 80–85 (FIG. 4). Fold lines 80–85 are arranged generally parallel to one another and at right angles to the longitudinal axis of body portion 60. Fold lines 80–85 function to define a lower panel 90, side panels 92, 94, upper edges 96, 98, and upper strips 101, 103. In its expanded position (FIGS. 1 and 5), body portion 60 has a generally U-shaped configuration, wherein side panels 92, 94 are upstanding and positioned generally normally to lower panel 90. Upper strips 101, 103 are folded back along the top portions of side panels 92, 94 and secured thereto through the use of staples 52 or other fastening means, such as adhesive (FIGS. 1, 2 and 11). Additionally, similar to the construction of outer member 12, upper strips 101, 103 are separated from side panels 92, 94 by double fold lines 80, 81 and 82, 83. Hence, fold lines 80–83 form narrow channels 105 which extend across the entire upper portions 22–23 of inner member 14.

Figure 5:
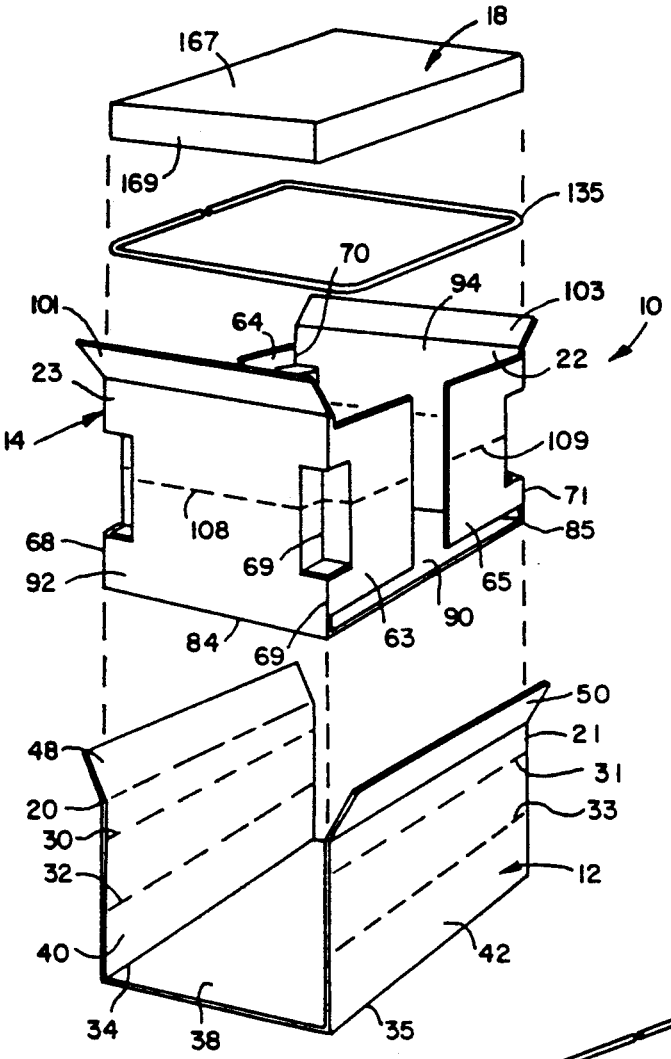
FIG. 5 is an exploded perspective view of the container in its erected position.

Inner member 14 further includes two additional transverse fold lines 108, 109 (FIGS. 4 and 5). Transverse fold lines 108, 109 are positioned to extend centrally through auxiliary portions 62–65 and side panels 92, 94. More specifically, fold line 108 extends centrally through the aligned regions of auxiliary portions 62–63 and panel 92; and fold line 109 extends centrally through aligned regions of auxiliary portions 64–65 and panel 94. Inner member 14 is folded along lines 108, 109 only when collapsed.

Inner member 14 further includes along each of the fold lines 68–71, a plurality of short slits 115–122 (FIG. 4). Slits 115–122 are grouped into pairs 115–116, 117–118, 119–120, 121–122, such that a pair of slits are positioned orthogonally across each of the fold lines 68-71. Each slit 115-122 is positioned to extend partially into an auxiliary portion 62–65 and a side panel 92, 94. Further, each slit 115–122 is generally arranged such that its mid-point corresponds with the particular intersected fold line 68–71.

Each pair of slits 115–122 is connected by an additional pair of short corner fold lines 125–132 (FIG. 4). Corner fold lines 125–132 are grouped into pairs and oriented generally parallel to the longitudinal axis of body portion 60. Corner fold lines 125–132 and slits 115–122 cooperatively define four generally rectangular corner members 141-144. When container 10 is erected, one corner member 141–144 is positioned in each side corner thereof.

When container 10 is assembled together in its erected position (FIGS. 1 and 5), outer and inner members 12, 14 cooperatively define cavity 16 adapted to receive various goods and the like. In particular, cavity 16 is bounded by four sides —two of which are formed by sidewalls 40, 42 and two of which are formed by side panels 92, 94. In this orientation, lower panel 90 is placed flush with and directly over bottom panel 38. Additionally, sidewalls 40, 42 and side panels 92, 94 are innersecured along their top portions 20–23 by a rigid loop 135, preferably composed of a slender metallic rod. Loop 135 has a generally rectangular configuration with rounded corners and is received through channels 54, 105.

In the erected position (FIGS. 1 and 5), auxiliary portions 62–65 are positioned generally at right angles to the side panels 92, 94 along fold lines 68–71. In this orientation, auxiliary portions 62, 64 are positioned against and generally parallel with sidewall 40; and auxiliary portions 63, 65 are positioned against and generally parallel with sidewall 42. As a consequence, inner member 14 overlaps sidewalls 40, 42 of outer member 12 and substantially closes the corners of cavity 16. This construction therefore avoids inadvertent loss of the items placed within container 10.

Figure 8:
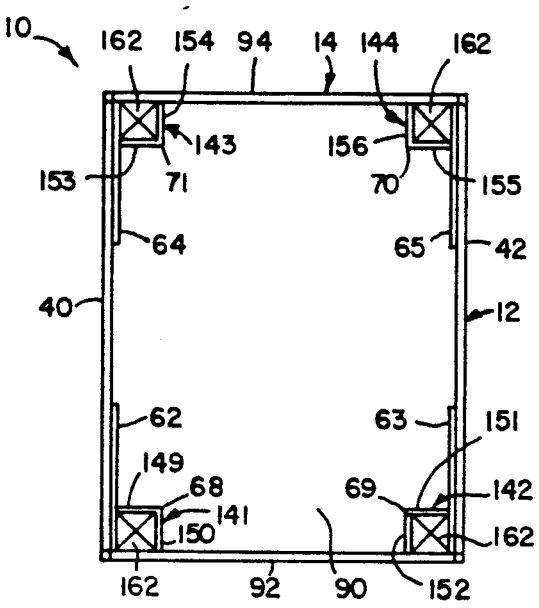
FIG. 8 is a top plan view of an erected container.
Figure 7:
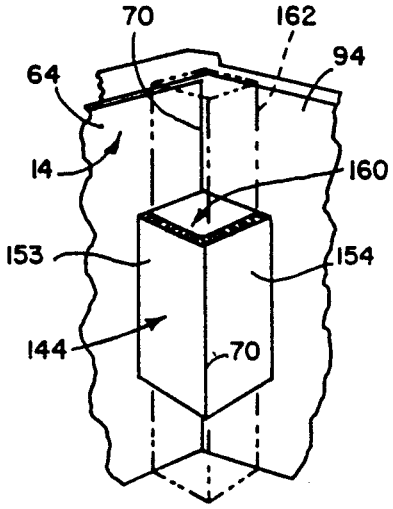
FIG. 7 is a perspective view of one inner corner of an erected container.
Figure 6:
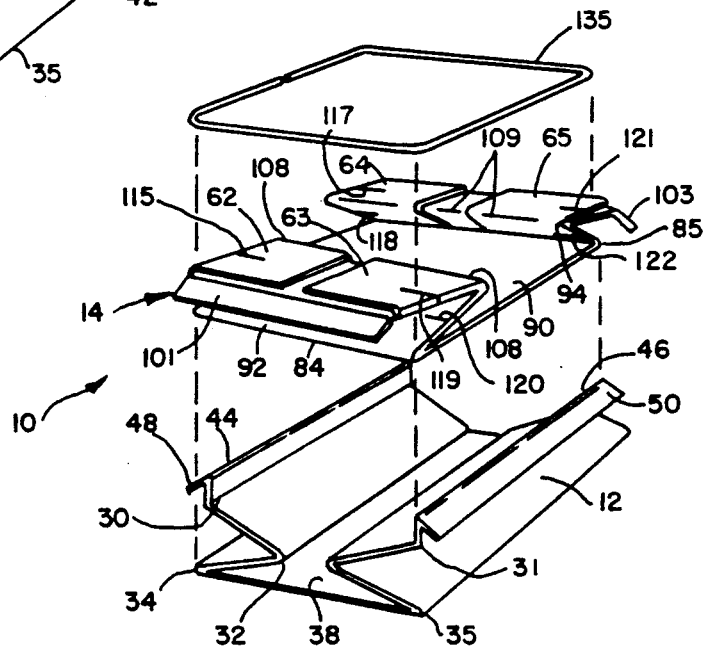
FIG. 6 is an exploded perspective view of the container in its collapsed position.

In the expanded position, one corner member 141–144 is positioned generally vertically in each of the four corners of container 10 (FIGS. 1, 7 and 8). Each of the corner members 141–144 are defined by a pair of corner panels 149–156 (FIGS. 4 and 8). More specifically, each of the corner members includes a corner panel 149, 151, 153, 155 which forms an integral part of one of the auxiliary portions 62–65, and a corner panel 150, 152, 154, 156 which forms an integral part of one of the side panels 92, 94.

To rigidify the erected construction, corner members are pressed into cavity 16 to define a pocket 160 in each corner of container 10 (FIGS. 1, 5, 7 and 8). Since all of the corner members have the same construction and operation, only corner member 141 will be discussed in detail (FIG. 7). In particular, corner member 141 is pressed inwardly such that corner panels 149, 150 are generally positioned at right angles to auxiliary portion 62 and side panel 92, respectively. The inverting of the fold along line 149 from an outwardly directed point to an inwardly directed point is an over-center arrangement which will maintain the corner member in either its inward or outward position. Nevertheless, the resilience of the container's components permits the corner members to be easily snapped into the two positions with slight manual pressure. Once all of the corner members have been moved into position so as to define rectangular pockets 160, rigid braces 162 are placed therein to prevent any collapse of the container. Braces 162 are preferably rectangular rods composed of wood. Of course other suitably rigid materials, such as many plastics and metals, could also be used.

Figure 9:
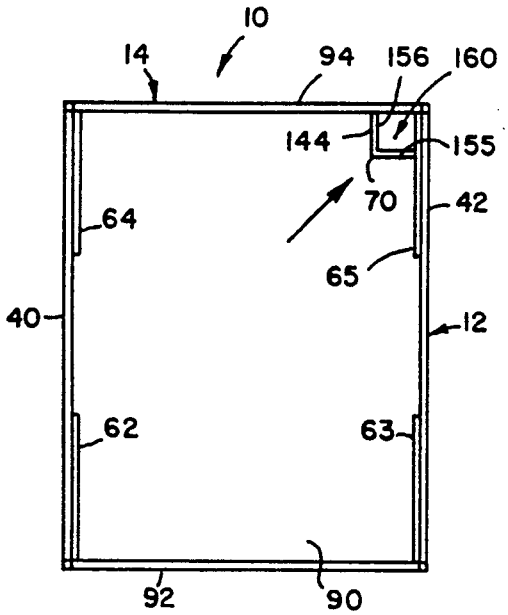
FIG. 9 is a top plan view of a container illustrating a step in collapsing the container.

To effect collapse of the container (FIG. 8), braces 162 are first removed from each of the pockets 160 formed in the corners of the container. Corner members 141–144 are then each pressed outwardly, so that they pass through their center positions and snap back into place (FIG. 9). In other words, corner members 141–144 are returned to their positions such that corner panels 149, 151, 153, 155 are once again coplanar with the corresponding auxiliary portion 62–65, and corner panels 150, 152, 154, 156 are coplanar with the corresponding side panel 92, 94.

Figure 10:
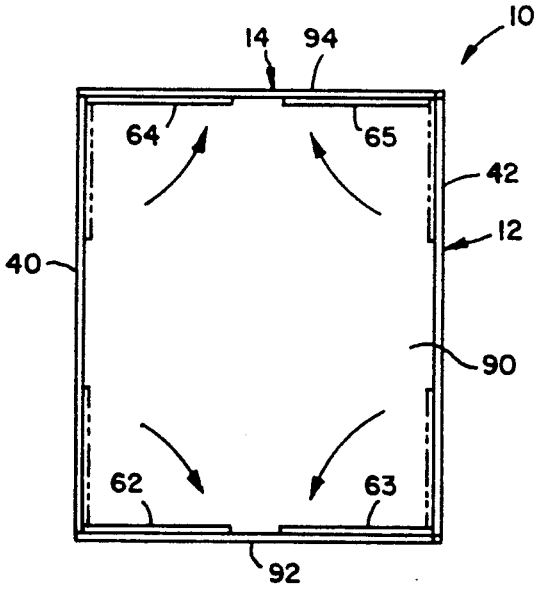
FIG. 10 is a top plan view of the container illustrating a step in collapsing the container.

At this point, auxiliary portions 62–65 are folded along lines 68–71 so as to lie generally against and parallel with the corresponding adjacent side panel 92, 94 (FIG. 10). In particular, auxiliary portions 62, 63 are folded against side panel 92, and auxiliary portions 64, 65 are folded against side panel 94. Preferably, auxiliary portions 62–65 are slightly smaller in height than side panels 92, 94, so that they do not become wedged against lower panel 90 during such folding.

With the auxiliary portions 62–65 folded against side panels 92, 94, lower panel 90 is raised toward top portions 22, 23 by inwardly folding side panels 92, 94 and auxiliary portions 62–65 along transverse fold lines 108, 109. The raising of lower panel 90 is continued until inner member 14 assumes a generally flat position.

Once lower panel 90 has been raised, side walls 40, 42 are folded inwardly to collapse outer member 12 (FIGS. 2, 6, 11 and 12). In particular, sidewalls 40, 42 are pressed inwardly along intermediate fold lines 32, 33 such that the sidewalls (between fold lines 27, 34 and 29, 35) define a generally inwardly directed V-shape between lower panel 90 and bottom panel 38.

As can be readily appreciated, this procedure enables the container to be collapsed in a downward direction, without incurring any increase in either of the lateral dimensions. Moreover, collapse of the container is facilitated without moving bottom panel 38. Hence, bottom panel 38 can be permanently secured to a pallet 19 (FIG. 1) without affecting the expansion or collapse of the container. Expansion of container 10 is preferably effected by performing in the opposite order the steps of collapsing the container.

Preferably, a lid is also used in conjunction with container 10 (FIG. 5). Lid 18 is of a conventional design and includes a top cover portion 167 and a peripheral lip 169 which is designed to matingly fit snugly over top portions 20–23 of container 10. The depth of lip 169 is sized to be no greater than the overall height of the collapsed container 10.

The above description is that of preferred embodiment of the invention. Various alterations and changes can be made without departing from the spirit and broader aspects of the invention as set forth in the appended claims, which are to be interpreted in accordance with the principles of patent law including the Doctrine of Equivalents.

The embodiments of the invention in which an exclusive property or privilege is claimed are defined as follows:

1. A container comprising a bottom portion and a plurality of side portions, said portions cooperatively defining in an erected orientation a cavity adapted to receive items therein, means for interconnecting together all of the upper extents of said side portions in generally rectangular relationship and defining a top end opposite said bottom portion, said portions further defining in said erected orientation lateral dimensions of said container, and each of said side portions being foldable into said cavity to collapse said container by moving said top end directly toward said bottom portion in a direction generally normal to said bottom portion while folding said side portions inwardly, said side portion upper extents remaining joined together in rectangular relationship, said bottom portion including a bottom panel which is substantially unaffected by said collapse, such that substantially no increase in said lateral dimensions of said container results by said collapse.

2. A container as defined in claim 1 in which said portions are defined by a pair of folded sheets interconnected together, wherein one of said sheets defines at least one of said side portions and said bottom panel, and the other of said sheets defines at least oen other of said side portions.

3. A collapsible container comprising a first member including a pair of opposed sidewalls and a bottom panel, a second member includnig a pair of opposed side panels and a lower panel, and means for interconnecting the upper extents of said first and second members in generally rectangular relationship, said first and second members being arranged with certain lateral dimensions to define a cavity when expanded, and being folded by moving said interconnected upper extents in a direction generally normal to said bottom panel with said upper extents remaining in generally rectangular relationship and with substantially no resultant increase in said lateral dimensions when collapsed.

4. A collapsible container as defined in claim 3 in which said first and second members each have a generally U-shaped configuration when expanded, and are arranged such that said sidewalls are positioned generally perpendicular to said side panels and said lower panel overlies said bottom panel.

5. A collapsible container as defined in claim 4 in which said sidewalls and said side panels each include upper and lower portions, wherein said lower portions of said sidewalls are contiguous with said bottom panel and said lower portions of said side panels are contiguous with said lower panel, and wherein said upper portions are joined together by said interconnecting means.

6. A collapsible container as defined in claim 4 in which said side panels include main sections positioned angularly to said sidewalls, and auxiliary sections positioned to each side of each said main section which overlie and are positioned generally parallel with said sidewalls when in said expanded position, wherein said main and auxiliary sections cooperatively define corner members which are coplanar with said corresponding sections when said container is collapsed and adjusted inwardly to form pockets when said container is expanded, and which further includes rigid braces which are inserted into said pockets when said container is expanded to rigidify and strength said container.

7. A collapsible container as defined in claim 3 in which said sidewalls and said side panels each include a lateral fold line medially positioned to extend thereacross, wherein said sidewalls and side panels are folded inwardly along said medial fold lines when collapsed.

8. A collapsible container as defined in claim 7 in which said lower panel is positioned above said medial fold lines of said sidewalls in said collapsed position.

9. A collapsible container as defined in claim 3 in which said sidewalls and said side panels each include upper and lower portions, wherein said lower portions of said sidewalls are contiguous with said bottom panel and said lower portions of said side panels are contiguous with said lower panle, and wherein said upper portions are joined together by said interconnecting means.

10. A collapsible container comprising a plurality of side portions, at least one bottom portion, and a plurality of generally rigid braces, said side portions being capable of arrangement in an expanded position and a folded collapsed position, said side portions and said at least one bottom portion defined by first and second members arranged such that said first and second members each define a plurality of said side portions, said side portions of said second member including main sections positioned angularly to said side portions of said first member, and auxiliary sections to each side of each said main section which overlie and are positioned generally parallel with said side portions of said first member when in said expanded position, wherein said main and auxiliary sections cooperatively define corner members which are coplanar with said corresponding sections when said container is collapsed and adjusted inwardly to form pockets when said container is expanded, said braces being received within said pockets when said container is expanded and removed from said pockets when said container is collapsed.

11. A collapsible container comprising a plurality of upstanding sidewalls and a bottom panel, each of said sidewalls projecting outwardly from said bottom panel and including a top end remote from said bottom panel, said top ends being interconnected in generally rectangular relationship to define a top end opening, said sidewalls being folded such that said top ends are moved directly towards said bottom panel in a generally orthogonal direction thereto while remaining in said rectangular relationship, and said botto mpanel remaining substantially unaffected irrespective of said expansion and collapse of said sidewalls.

12. A collapsible container as defined in claim 11 further including a first member defining a pair of sidewalls and said bottom panel, and a second member defining a second pair of said sidewalls and a lower panel overlying said bottom panel, and means for interconnecting said first and second members together substantially along their top ends.

13. A collapsible container as defined in claim 12 wherein said sidewalls cooperatively define substantially the same lateral dimensions when expanded and collapsed.

14. A collapsible container as defined in claim 11 wherein said sidewalls cooperatively define substantially the same lateral dimensions when expanded and collapsed.

15. An assembly comprising a collapsible container and a pallet, said pallet includign an upper supporting surface, said container including a plurality of upstanding sidewalls and a bottom panel, said bottom panel being secured to said upper supporting surface of said pallet, each of said sidewalls projecting outwardly from said bottom panel and including a top end remote from said bottom panel, said top ends being interconnected in generally rectangular relationship to define a top end opening, said sidewalls being folded such that said top ends are moved directly toward said bottom panel in a generally orthogonal direction thereto, said rectangular relationship and said bottom panel remaining substantially unaffected irrespective of said expansion and collapse of said sidewalls.

16. An assembly as defined in claim 15 in which said container further includes a first member which defines a pair of sidewalls and said bottom panel, and a second member which defines a second pair of said sidewalls and a lower panel overlying said bottom panel, and means for interconnecting said first and second members together substantially along their top ends.

17. An assembly as defined in claim 16 wherein asid sidewalls of said container cooperatively define substantially the same lateral dimensions when expanded and collapsed.

18. An assembly as defined in claim 15 wherein said sidewalls of said container cooperatively define substantially the same lateral dimensions when expanded and collapsed.

19. A collapsible container comprising a first member, a second member, means for interconnecting said first and second members, and braces, said member each including a plurality of sidewalls and a bottom panel, said members being positionable alternatively in a collapsed position and an erected position, each of said members in said erected position being defined such that said sidewalls of said members form a cavity to receive items therein and said bottom panel of said second member overlies said bottom panel of said first member, said sidewalls of said second member further defining pockets in the corners of said defined cavity when in said erected position, said braces being removably received in said pockets to strengthen said container when erected, and each of said members being foldable such that said container experiences substantially no increase in its lateral dimensions when collapsed, said sidewalls of said second member each including a main section and a pair of auxiliary sections extending from each side thereof, wherein said sidewalls of said first member are oriented generally perpendicular to said main section and generally parallel to said auxiliary sections when said container is erected.

20. A collapsible container as defined in claim 19 in which said pockets are collapsible against said sidewalls of said second member when said container is collapsed.

21. A collapsible container comprising a first member including a pair of opposed sidewalls and a bottom panel, a second member including a pair of opposed side panels and a lower panel, said sidewalls and said side panels each including a lateral fold line medially positioned to extend thereacross, and means for interconnecting first and second members said first and second members being arranged with certain lateral dimensions to define a cavity when expanded, and being folded with substantially no resultant increase in said lateral dimensions when collapsed, wherein said sidewalls and side panels are folded inwardly along said medially positioned fold lines when collapsed.

22. A collapsible container as defined in claim 21 in which said lower panel is positioned above said medial fold lines of said sidewalls in said collapsed position.

23. A collapsible container comprising a first member, a second member, means for interconnecting said first and second members, and braces, said members each including a plurality of sidewalls and a bottom panel, said member being positionable alternatively in a collapsed position and an erected position, each of said membes in said erected position being defined such that said sidewalls of said members form a cavity to receive items therein and said bottom panel of said second member overlies said bottom panel of said first member, said sidewalls of said second member further defining pocket sin the corners of said defined cavity when in said erected position, said braces being removably received in said pockets to strengthen said container when erected, and each of said members being foldable such that said container experiences substantially no increase in its lateral dimensions when collapsed, said sidewalls of each said member at least in part folded into a V-shaped configuration overlying said bottom panel of said first member when said container is collapsed.

* * * * *

UNITED STATES PATENT AND TRADEMARK OFFICE

CERTIFICATE OF CORRECTION

PATENT NO. : 5,071,010

DATED : December 10, 1991

INVENTOR(S) : Marie D. Carufel/Zeman

It is certified that error appears in the above-identified patent and that said Letters Patent is hereby corrected as shown below:

Column 5, claim 2, line 44:
the word "oen" should be --one--.

Column 5, claim 3, line 48:
the word "includnig" should be --including--.

Column 6, claim 9, line 30:
the word "panle" should be --panel--.

Column 6, claim 11, line 62:
the words "botto mpanel" should be --bottom panel--.

Column 7, claim 15, line 13:
the word "includign" should be --including--.

Column 7, claim 17, line 34:
the word "asid" should be --said--.

Column 7, claim 19, line 44:
the word "member" should be --members--.

UNITED STATES PATENT AND TRADEMARK OFFICE

CERTIFICATE OF CORRECTION

PATENT NO. : 5,071,010

DATED : December 10, 1991

INVENTOR(S) : Marie D. Carufel/Zeman

It is certified that error appears in the above-identified patent and that said Letters Patent is hereby corrected as shown below:

Column 8, claim 23, line 36:
the word "member" should be --members--.

Column 8, claim 23, line 38:
the word "membes" should be --members--.

Column 8, claim 23, line 43:
the words "pocket sin" should be --pockets in--.

Signed and Sealed this

Twentieth Day of April, 1993

*Attest:*

MICHAEL K. KIRK

*Attesting Officer*

*Acting Commissioner of Patents and Trademarks*